US005511880A

United States Patent [19]

Macemon

[11] Patent Number: 5,511,880

[45] Date of Patent: Apr. 30, 1996

[54] METHOD AND APPARATUS FOR STORING AND MIXING A PLURALITY OF FLUIDS AND BODY FLUID SAMPLING CARTRIDGE USING SAME

[75] Inventor: James H. Macemon, Redmond, Wash.

[73] Assignee: SpaceLabs Medical, Inc., Redmond, Wash.

[21] Appl. No.: 312,766

[22] Filed: Sep. 27, 1994

[51] Int. Cl.[6] ..... B01F 9/00

[52] U.S. Cl. ..... 366/213; 366/235

[58] Field of Search ..... 366/213, 208, 366/214, 215, 218, 219, 220, 232, 235, 237, 348, 349

[56] References Cited

U.S. PATENT DOCUMENTS

| | | | |
|---|---|---|---|
| 3,030,082 | 4/1962 | Matzen | 366/209 |
| 3,091,435 | 5/1963 | Pease | 366/208 |
| 3,294,663 | 12/1966 | Lazaro | 366/208 |
| 4,848,917 | 7/1989 | Benin | 366/208 |
| 5,044,428 | 9/1991 | Nohl | 366/220 |
| 5,143,084 | 9/1992 | Macemon | 128/771 |
| 5,399,013 | 3/1995 | Sawyer | 366/213 |

*Primary Examiner*—Robert W. Jenkins
*Attorney, Agent, or Firm*—Seed and Berry

[57] ABSTRACT

A mixing device includes a plurality of elongated ampules mounted on a rotatable support with the longitudinal axis of each ampule inclined inwardly toward the rotational axis of the rotatable support. When the mixing device rotates about the rotational support, centrifugal force causes fluid in each ampule to move toward the end farthest away from the rotatable support. A bubble in each ampule then moves toward the opposite end. In one embodiment, the rotational support is inclined so that the end of each ampule positioned farthest from the rotational support is positioned sufficiently above the other end so that the bubble rises to the end farther from the support in at least one position as the support rotates. As a result, a bubble in each ampule moves back and forth between the ends of the ampule as the rotatable support rotates to mix respective fluids in the ampules. In another embodiment, the ampules are pivotably mounted on the elongated support so that opposite ends are alternately positioned farthest from the support, thereby causing a bubble to move back and forth in each ampule. A chamber for collecting a blood sampling may be positioned on the rotatable support for subsequent analysis by an analysis machine that uses the fluids in the ampules for calibrating and washing purposes.

19 Claims, 7 Drawing Sheets

METHOD AND APPARATUS FOR STORING AND MIXING A PLURALITY OF FLUIDS AND BODY FLUID SAMPLING CARTRIDGE USING SAME

TECHNICAL FIELD

This invention relates to mixing devices, and more particularly, a method and apparatus for mixing a plurality of fluids contained in respective ampules which may be part of a body fluid sampling cartridge.

BACKGROUND OF THE INVENTION

It is necessary in a variety of fields to mix fluids that have separated from each other after being stored in a container for a period of time. Prior art mixers generally operate using one of a limited number of mixing actions such as, for example, rapid up/down movement or shaking of the container, rotation of the container in opposite directions, and rocking devices which tilt the container back and forth. The mixing effectiveness of these conventional mixing devices can often be enhanced by placing mixing beads or bars within the vessel so that the beads or bars are propelled through the fluid by the mixing action.

Regardless of which conventional technique is used, mixing devices are generally incapable of occupying a small Space, using a minimum of power and mixing rapidly without the aid of a mixing bead or other object within the container.

One application in which a compact, low power, and highly effective mixing device is required is to mix calibrating and washing fluids in a blood sampling cartridge of the type described and claimed in U.S. Pat. No. 5,143,084, which is incorporated herein by reference. As disclosed in U.S. Pat. No. 5,143,084, a sampling cartridge contains a body fluid storage chamber in which a body fluid, such as blood, is collected. The cartridge interfaces with an analysis system that receives the body fluid from the body fluid chamber as well as washing and calibrating fluids from ampules that form part of the cartridge. The fluids in the ampules become separated from each other in storage, and the fluids in each of the ampules must thus be mixed prior to flowing into the analysis system. The mixing device should be incorporated into the analysis system, and it is important that doing so does not unduly increase the size, weight, power requirements or price of the analysis system. Furthermore, since the analysis system must rapidly analyze samples, it is important that the mixing device be highly efficient in quickly providing substantially complete mixing of the fluids in each of the ampules. As a result, there has not heretofore been available a mixing device that is ideally suited for use in an analysis system that interfaces with body fluid sampling cartridges of the type disclosed in U.S. Pat. No. 5,143,084.

SUMMARY OF THE INVENTION

The inventive mixing device includes a fluid storage and mixing device which may be operatively coupled to a rotational device. The fluid storage and mixing device preferably includes an elongated support having a longitudinal axis, and at least one ampule mounted on the support. The ampule contains a fluid having a plurality of components. The fluid only partially fills the ampule so that a gas bubble is formed in the ampule. The ampule is mounted on the elongated support spaced apart from the longitudinal axis with the ampule angled inwardly toward the longitudinal axis so that a first end of the ampule is positioned farther from the longitudinal axis than a second end of the ampule.

The rotational device may be operatively coupled to the elongated support to rotate the support about the longitudinal axis. As a result, the centrifugal force exerted on the fluid in the ampule causes the bubble in the ampule to move toward the second end of the ampule. In one aspect of the invention, the support is oriented at an angle that is included upwardly sufficiently so that the first end of the ampule is positioned beneath the second end when the ampule is positioned directly beneath the longitudinal axis of the support. In accordance with this aspect of the invention, the rotational device operates at two rotational velocities. At a stationary, or relatively slow velocity, the force of gravity exerted on the fluid in the direction of the second end when an ampule containing the fluids is positioned beneath the longitudinal axis causes the bubble to move toward the first end. At a relatively high velocity, a centrifugal force exerted on the fluid in the direction of the first end even when an ampule containing the fluids is beneath the longitudinal axis causes the bubble to move toward the second end. As a result, as the rotational velocity cycles between the relatively slow and fast speeds, the bubble alternative moves in opposite directions to mix the fluid in the ampule. The relatively slow velocity is preferably sufficiently fast to cause the bubble to flatten thereby providing a path to allow the fluid to flow past the bubble when the bubble moves from the second end toward the first end.

The mixing device may, but need not, be part of a body fluid sampling cartridge that includes a fluid chamber for receiving a body fluid, such as blood, for subsequent analysis by an analyzing system that uses the fluids in the ampules for calibrating and washing purposes.

In another aspect of the invention, the ampule is pivotally mounted on the support so that the ampule can pivot between a first position in which the first end of the ampule is positioned farther from the longitudinal axis than the second end of the ampule; and a second position in which the second end of the ampule is positioned farther from the longitudinal axis than the first end of the ampule. An actuating mechanism causes the ampule to alternately pivot between the first and second positions, thereby causing a force exerted on the fluid in the ampule to alternate in opposite directions. As a result, the bubble alternately moves in opposite directions to mix the components of the fluid in the ampule.

DETAILED DESCRIPTION OF THE INVENTION

Figure 1:
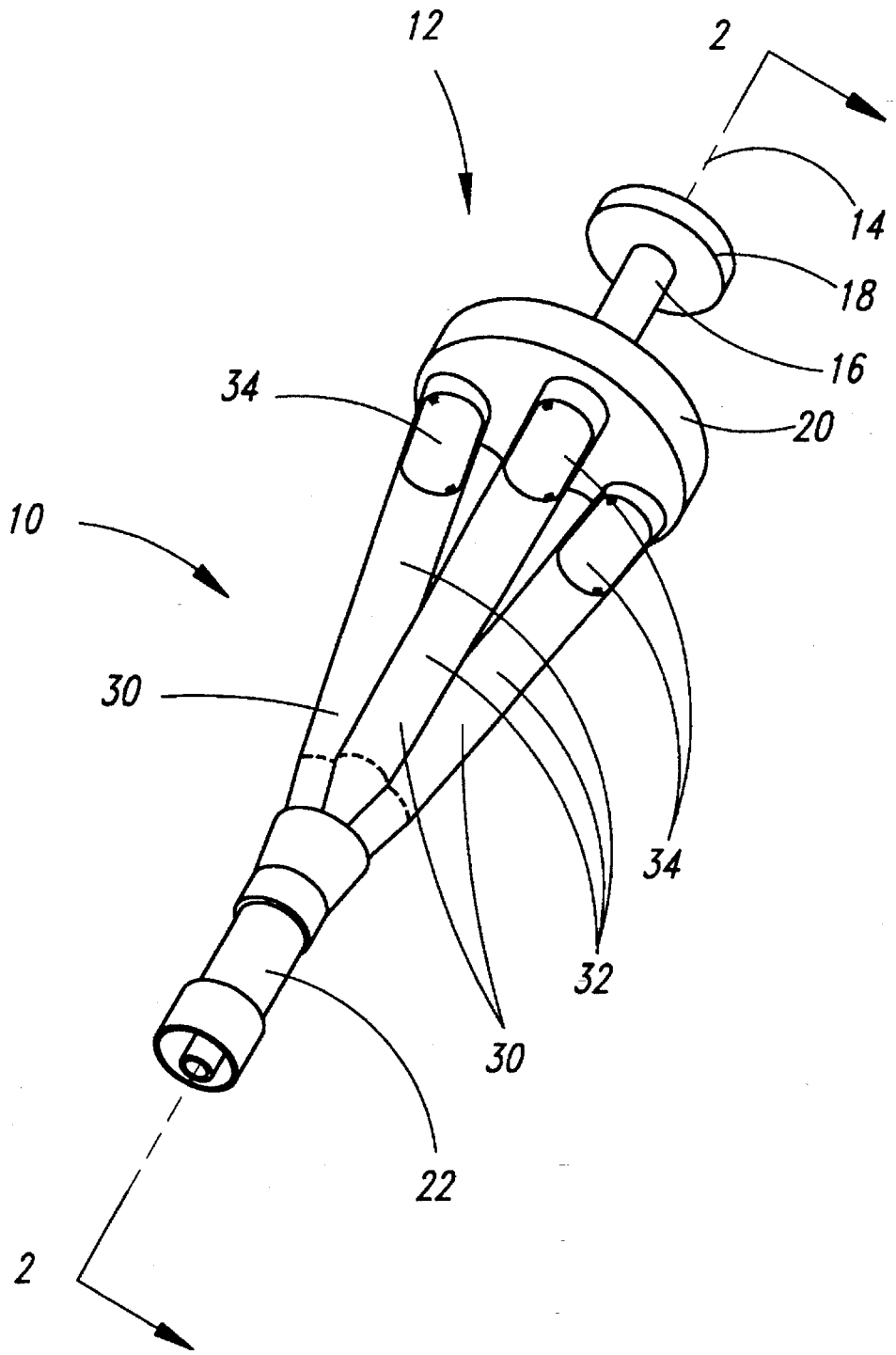
FIG. 1 is an isometric view of one embodiment of the inventive mixing apparatus.

One embodiment of the inventive device for storing and mixing fluids 10 is illustrated in FIG. 1. The device includes an elongated support, generally indicated at 12, having a longitudinal axis 14 about which the device 10 is adapted to rotate, as explained in greater detail below. The support 12 includes a support rod 16 having an outwardly extending flange 18, an ampule support plate 20 and a cylindrical end support 22. A plurality of ampules 30 extend between the ampule support plate 20 and the end support 22. Each of the ampules 30 contain a respective fluid 32 having a plurality of components, and a respective gas bubble 34. The components in the fluid may be two or more different fluids, a gas dissolved in a fluid, a solid dissolved in a fluid, or any combination of the above.

As illustrated in FIG. 1, the longitudinal axis 14 of the mixing device 10 is angled upwardly so that the bubbles 34 are positioned at the ends of the ampules 30 that are connected to the ampule support plate 20. It is important to note for the reasons explained below that the ends of the ampules 30 mounted on the ampule support plate 20 are farther from the longitudinal axis 14 than the opposite ends of the ampules 30.

Figure 2:
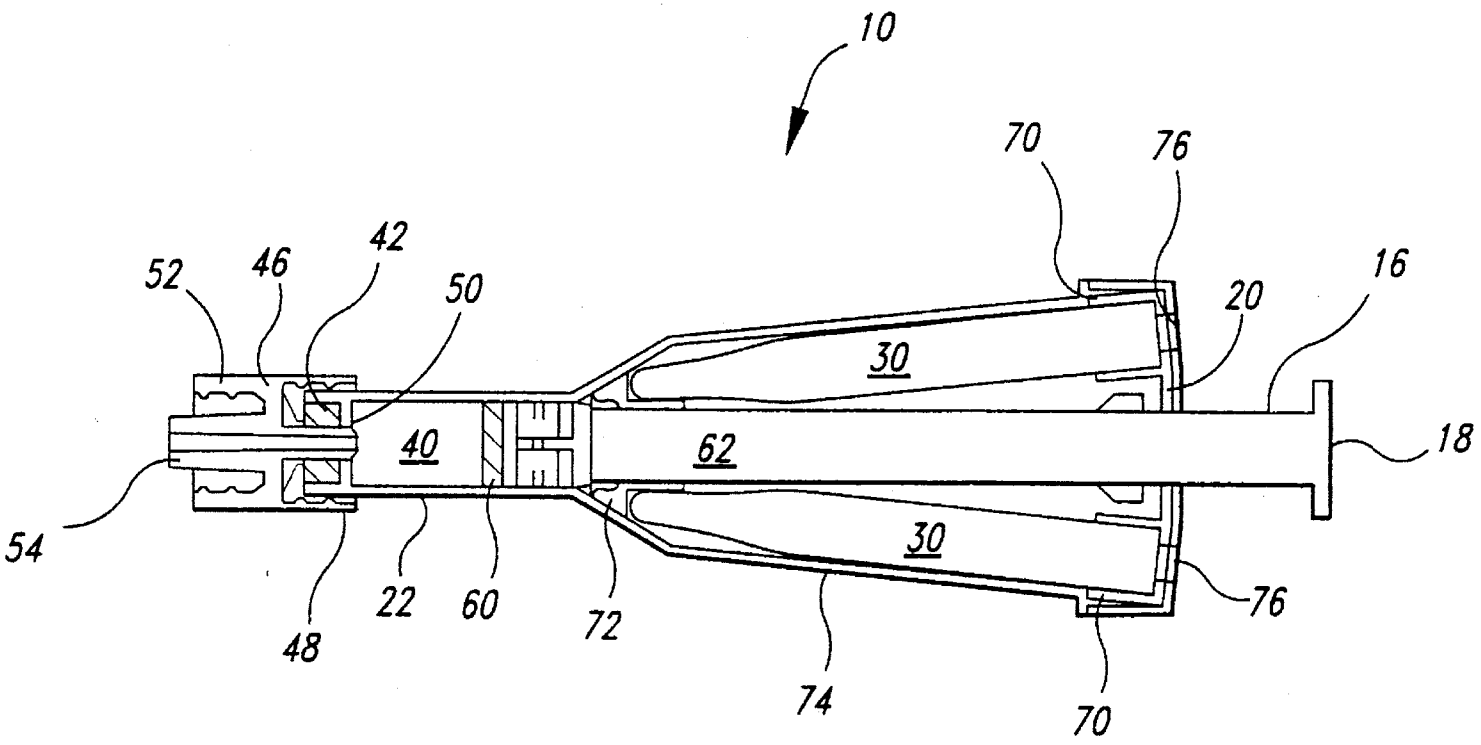
FIG. 2 is a cross section view of the mixing apparatus of FIG. 1 taken along the line 2—2 of FIG. 1.

The structural details of the mixing device 10 are illustrated in greater detail in FIG. 2. With reference to the left side of FIG. 2, the end support 22 is in the form of a cylindrical body fluid chamber 40 which is closed at its end by a resilient seal 42 having a center opening. A needle adapter 46 has a first cylindrical flange 48 which fits over the cylindrical end support 22. In this configuration, a needle member 50 of the needle adapter 46 extends through the seal 42 to communicate with the chamber 40. A similar flange 52 and needle member 54 project in opposite directions and are adapted to receive a conventional hypodermic needle. A piston 60 slidably mounted in the chamber 40 is coupled to a plunger 62 which forms part of the support rod 16 and flange 18 shown in FIG. 1.

As also illustrated in FIG. 2, the ampule support plate 20 has formed therein a plurality of cylindrical bosses 70 each of which receives an end of a respective ampule 30. The opposite ends of the ampules 30 fit into a support member 72 through which the plunger slidably extends. The ampules 30 are then surrounded by a cover 74.

In operation, a hypodermic needle (not shown) is placed on the needle holder 54 of the needle adapter 46 and the needle then punctures an artery of a patient. The plunger 62 is then withdrawn to draw blood into the chamber 40. After the needle adapter 46 has been removed, the mixing device 10 is placed in fluid communication with an analysis system which withdraws the blood from the chamber 40 as well as calibration and washing fluid from the ampules 30 through an opening 76.

Although the inventive mixing device is illustrated and explained as being part of a body fluid collection cartridge, it will be understood that the mixing device need not be part of a body fluid collection cartridge or other device.

Figure 3:
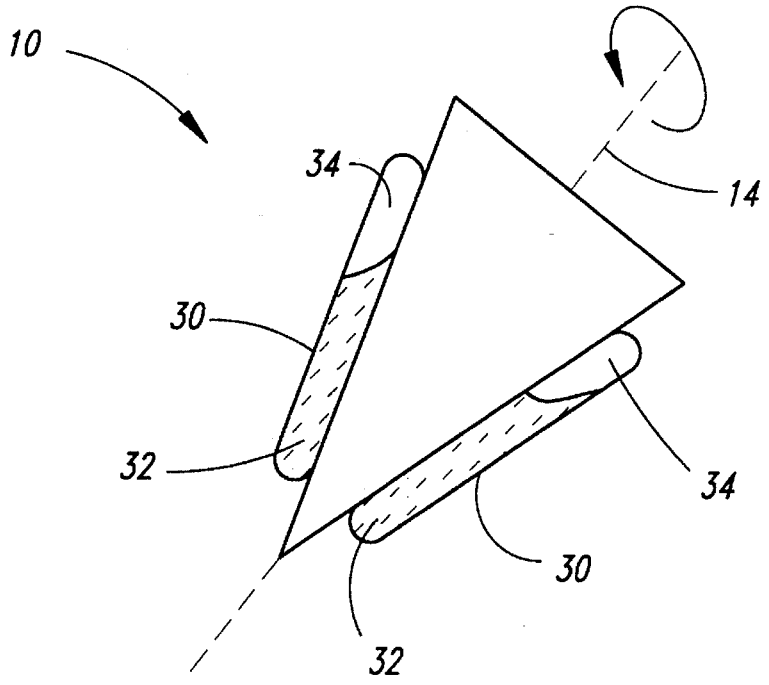
FIG. 3 is a schematic view illustrating the position of a bubble in an ampule when the mixing apparatus is either stationary or rotating slowly.
Figure 4:
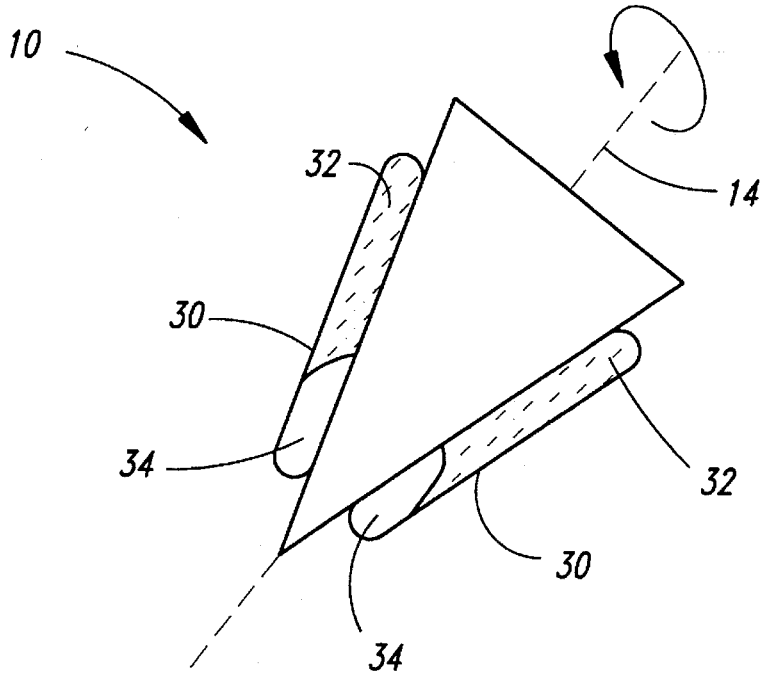
FIG. 4 is a schematic view illustrating the position of a bubble in an ampule when the mixing apparatus is rotating at a relatively high speed.

The manner in which the mixing device illustrated in FIGS. 1 and 2 mixes the fluid in the ampules 30 is illustrated with reference to FIGS. 3 and 4. With reference to FIG. 3, when the device 10 is oriented with the longitudinal axis 14 extending upwardly and the device 10 is either stopped or rotating very slowly, the bubbles 34 are positioned at the upper portion of the ampules 30 as illustrated in FIGS. 1 and 3. The bubbles 34 are positioned at the top of the ampules 30 because the fluid 32 in the ampules is heavier than the gas forming the bubbles 34. With reference to FIG. 4, when the device 10 rotates at a relatively high speed, centrifugal force causes the fluid 32 in the ampule 30 to flow outwardly away from the longitudinal axis of the device 10 about which the device rotates. The only way that the fluid 32 can flow outwardly is for the fluid 32 to flow toward the upper end of the ampule 30, thereby displacing the bubble 34 to the lower ends of the ampule 30. By alternately speeding up and slowing down the rotation of the device, the bubble 34 is made to move back and forth between the ends of the ampule, thereby mixing the fluid 32 in the ampule 30.

Figure 5:
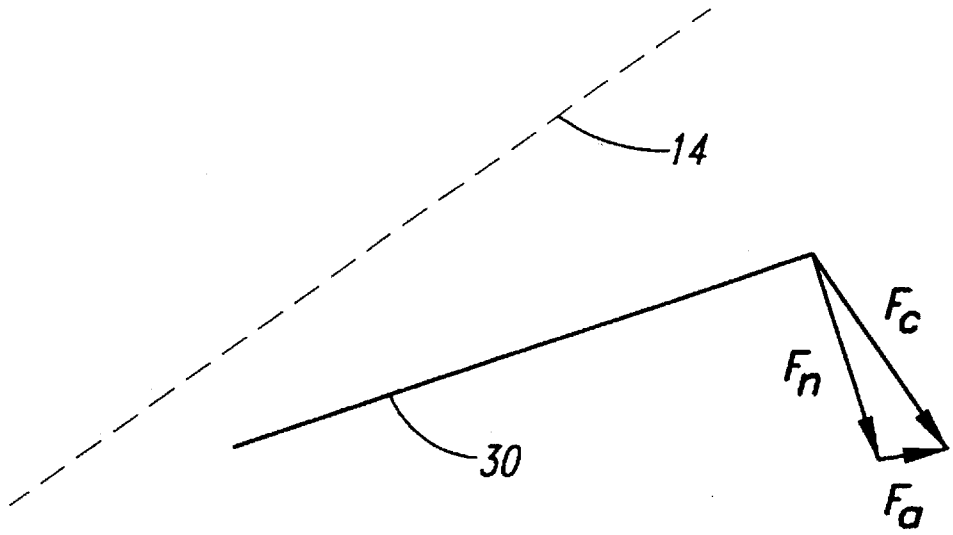
FIG. 5 is a force vector diagram showing the forces acting on a fluid in an ampule as a result of rotation of the mixing apparatus.
Figure 6:
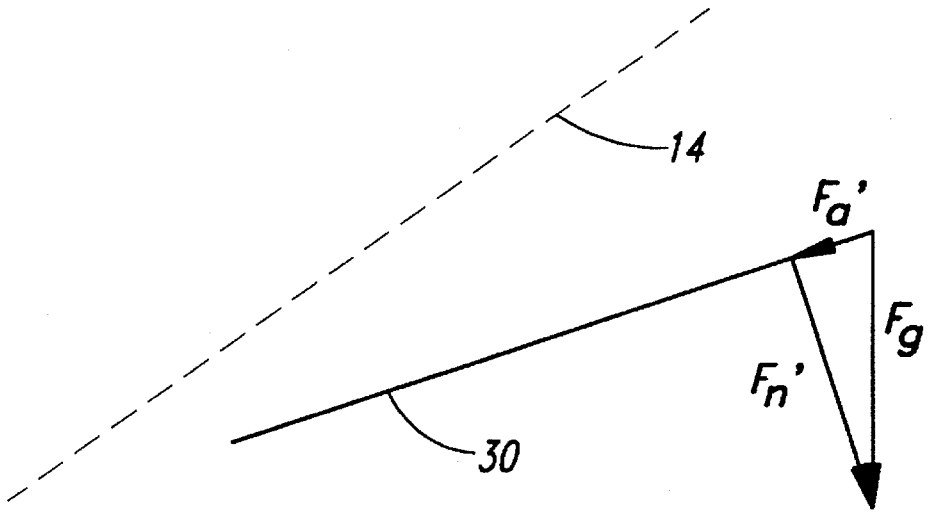
FIG. 6 is a force vector diagram showing the forces acting on a fluid in an ampule as a result of gravity.

The manner in which the rotation of the device 10 causes the bubble 34 to move from end to end is illustrated in FIGS. 5 and 6. FIG. 5 shows the force exerted on the fluid 32 when the device 10 is rotating at a relatively high speed. The rotation of the device imparts a centrifugal force $F_c$ to the fluid which acts in a direction perpendicular to the longitudinal axis 14. This force vector $F_c$ that is perpendicular to the axis of rotation 14 can be divided into two components, one of which $F_n$ acts perpendicular to the longitudinal axis of the ampule 30 and the other of which $F_a$ acts along the longitudinal axis of the ampule 30. The axial component $F_a$ forces the fluid toward the end that is farthest away from the longitudinal axis 14 as illustrated in FIG. 4. It will be apparent that the magnitude of the force $F_a$ is directly proportional to the magnitude of the centrifugal force $F_c$, and it can be increased by simply rotating the device 10 at a higher rotational velocity.

The forces exerted on the fluid 32 in the ampules 30 when the device 10 is not rotating is illustrated in FIG. 6. When the device is not rotating, the force of gravity $F_g$ acts on the fluid 32 in a downward direction. This downward force vector $F_g$ can be divided into two components. The first component, $F_n'$, acts normal to the longitudinal axis of the ampule 30 while the second component, $F_a'$, acts along the axis of the ampule 30. This axial component $F_a'$ forces the fluid 32 downwardly to the position illustrated in FIG. 3. Since the force vector $F_a$ caused by rotation of the device 10 is in the opposite direction of the force vector $F_a'$ caused by gravity, these axial forces cause the bubble to move from one end of the ampule 30 to the other. While the axial force $F_a$ resulting from centrifugal force can be increased by rotating the device at a faster rate, the axial force $F_a'$ resulting from gravity can be increased by increasing the angle of inclination of the axis 14. However, as long as the centrifugal axial force $F_a$ is made to be alternately greater and less than the axial force $F_a'$ resulting from gravity, mixing of the fluids 32 in the ampules 30 will occur.

Figure 7:
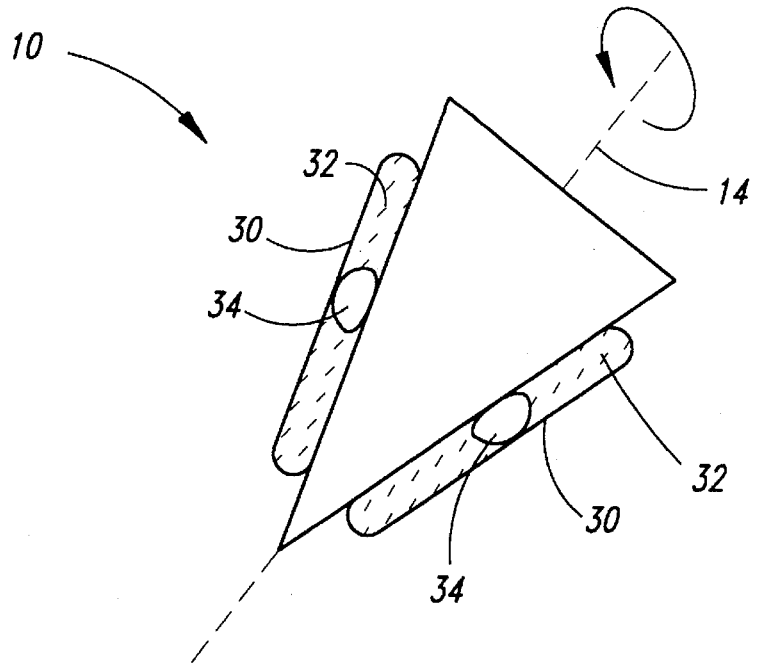
FIG. 7 is a schematic view showing of a bubble rising through an ampule while the mixing apparatus is stationary.
Figure 8:
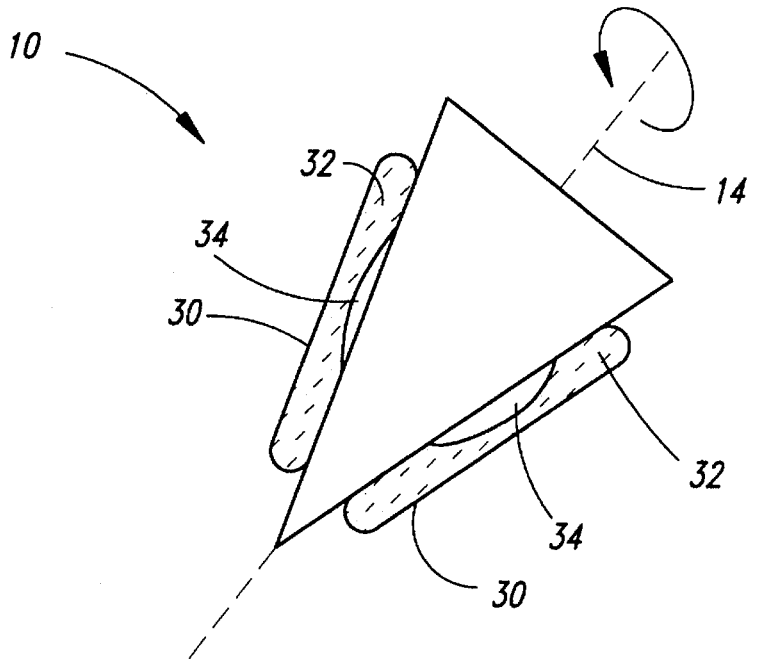
FIG. 8 is a schematic view showing of a bubble rising through an ampule while the mixing apparatus is rotating at a moderate speed.

One potential limitation on the effectiveness of mixing is apparent from FIG. 7 which shows the device 10 stationary and the bubble 34 traveling from the lower end of the ampule 30 to the upper ends of the ampule 30. The bubble 34 occupies the entire diameter of the ampule 30, thus blocking the free flow of fluid 32 from one end of the ampule 30 to the other. As a result, it requires a relatively long period of time for the bubble 34 to travel from one end of the ampule 30 to the other. This time delay limits the rate at which the rotational velocity of the device 10 can cycle back and forth to cause the bubble 34 to move between the ends of the ampule 30. However, this potential limitation on the efficiency of the inventive mixing device is largely solved by rotating the device 10 at a moderate speed, as illustrated in FIG. 8. When the device 10 rotates at a moderate speed, the normal force $F_n$ (FIG. 5) exerted on the fluid 32 causes the bubble 34 to flatten out as illustrated in FIG. 8. Once the bubble 34 flattens, there is a substantial fluid path around the bubble 34. At this moderate rotational speed, the gravity force vector $F_a'$(FIG. 6) is greater than the centrifugal force vector $F_a$ (FIG. 5) so that the bubble 34 travels to the right in FIG. 8. However, the fluid path around the bubble 34 allows the fluid 32 to more easily flow from one end of the ampule 30 to the other. As a result, the bubble 34 moves from the left end of the ampule 30 to the right end of the ampule 30 at a significantly faster rate.

The inventive mixing device, while illustrated as part of a blood sampling cartridge, can be advantageously used in any application in which a compact, low power device is required to efficiently and rapidly mix fluids in enclosed containers.

Figure 9:
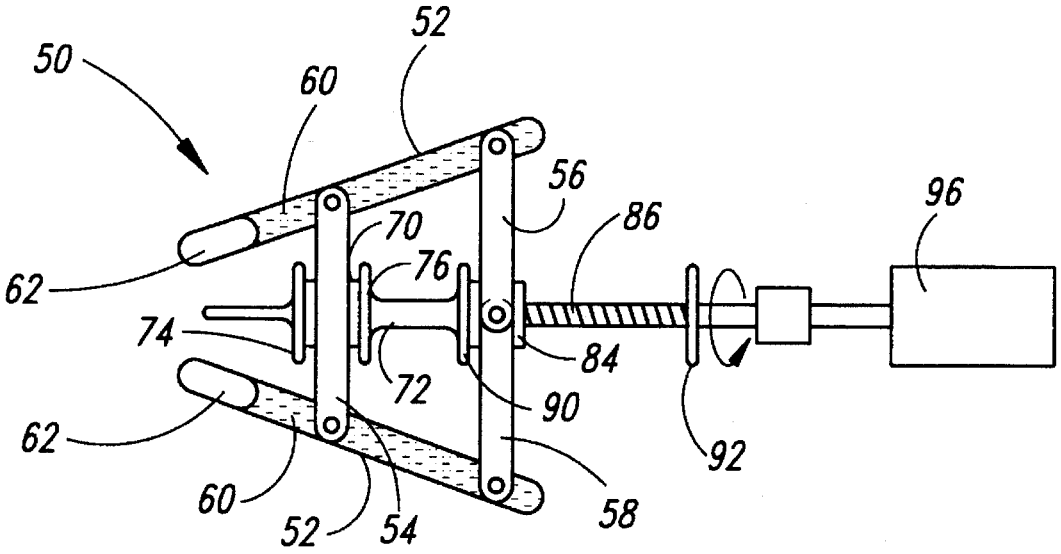
FIG. 9 is a schematic elevational view of an alterative embodiment of the inventive mixing apparatus showing the ampules in a first position.
Figure 10:
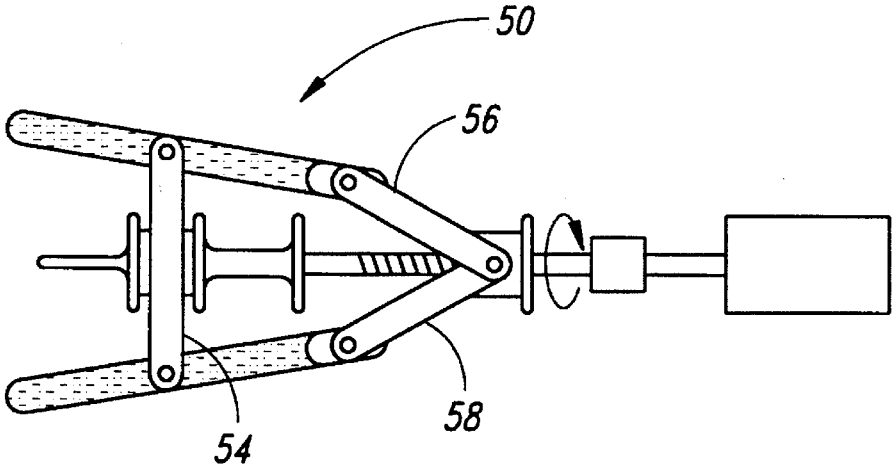
FIG. 10 is a schematic elevational view of the alternative embodiment of FIG. 9 showing the ampules in a second position.

An alternative embodiment of the inventive mixing device is illustrated in FIGS. 9 and 10. The mixing device 50 supports a pair of ampules 52 that are pivotally secured to a stationary arm 54 and pair of pivoting arms 56, 58. The ampules 52 each contain a fluid 60 having two or more components and a gas bubble 62. The stationary arm 54 is fixedly mounted on a bearing 70 that is rotatably mounted on a shaft 72. The axial position of the bearing 70 is fixed by a pair of stop members 74, 76 that are formed on the shaft 72. The inner ends of the arms 56, 58 are pivotally connected to a nut 84 that engages a threaded portion 86 of the shaft 72. Stop members 90, 92 are formed on the shaft 72 on opposite sides of the threaded portion 86. The shaft 72 is coupled to a bidirectional motor 96 of conventional design.

In operation, the motor 96 first rotates the shaft 72 in a counterclockwise direction. As a result, the nut 84 rotates on the threaded portion 86 of the shaft 72 thereby causing the nut 84 to move away from the motor 96 until it contacts the stop member 90, as shown in FIG. 9. In this position, the right ends of the ampules 52 are farther from the shaft 72 than are the left ends of the ampules 52. As the motor 96 thereafter continues to rotate the shaft 72, the nut 84 rotates with the shaft 72, and this rotation is coupled through the pivotally mounted arms 56, 58 to the ampules 52. When the ampules 52 rotate, the centrifugal force has an axial component that acts on the fluid 60 to the right, thus causing the bubbles 62 to move to the left ends of the ampules 52, as shown in FIG. 9.

After a period of time that is sufficient to allow the bubbles 62 to move to the left ends of the ampules 52, the motor 96 rotates the shaft 72 in a clockwise direction. The nut 84 then rotates on the threaded portion 86 of the shaft in a counterclockwise direction so that the nut 84 moves toward the motor 96 until it contacts the stop member 92, as shown in FIG. 10. In this position, the left ends of the ampules 52 are farther from the shaft 72. The nut 84 then rotates the ampules 52 in a clockwise direction, thereby causing the bubbles 62 to move to the right ends of the ampules 52, as shown in FIG. 10.

Alternately rotating the motor 96 in opposite directions causes the bubbles 62 to alternately move back and forth between the ends of the ampules 52 to mix the components of the fluids 60 in the ampules 52. One advantage of the embodiment of FIGS. 9 and 10 is that it does not require gravity to operate, and can thus be used in space applications. Also, since the axial force can be increased at will by simply rotating the shaft 72 faster, the embodiment of FIGS. 9 and 10 is capable of driving the bubbles 62 between the ends of the ampules 52 at a faster rate, thus providing more rapid mixing. Finally, since the ampules 52 are rotating while the bubbles 62 are traveling through the ampules 52, the normal component $F_n$ of the centrifugal force $F_c$ (FIG. 5) causes them to flatten as shown in FIG. 8, thus causing the bubbles 62 to travel at a faster rate.

Figure 11:
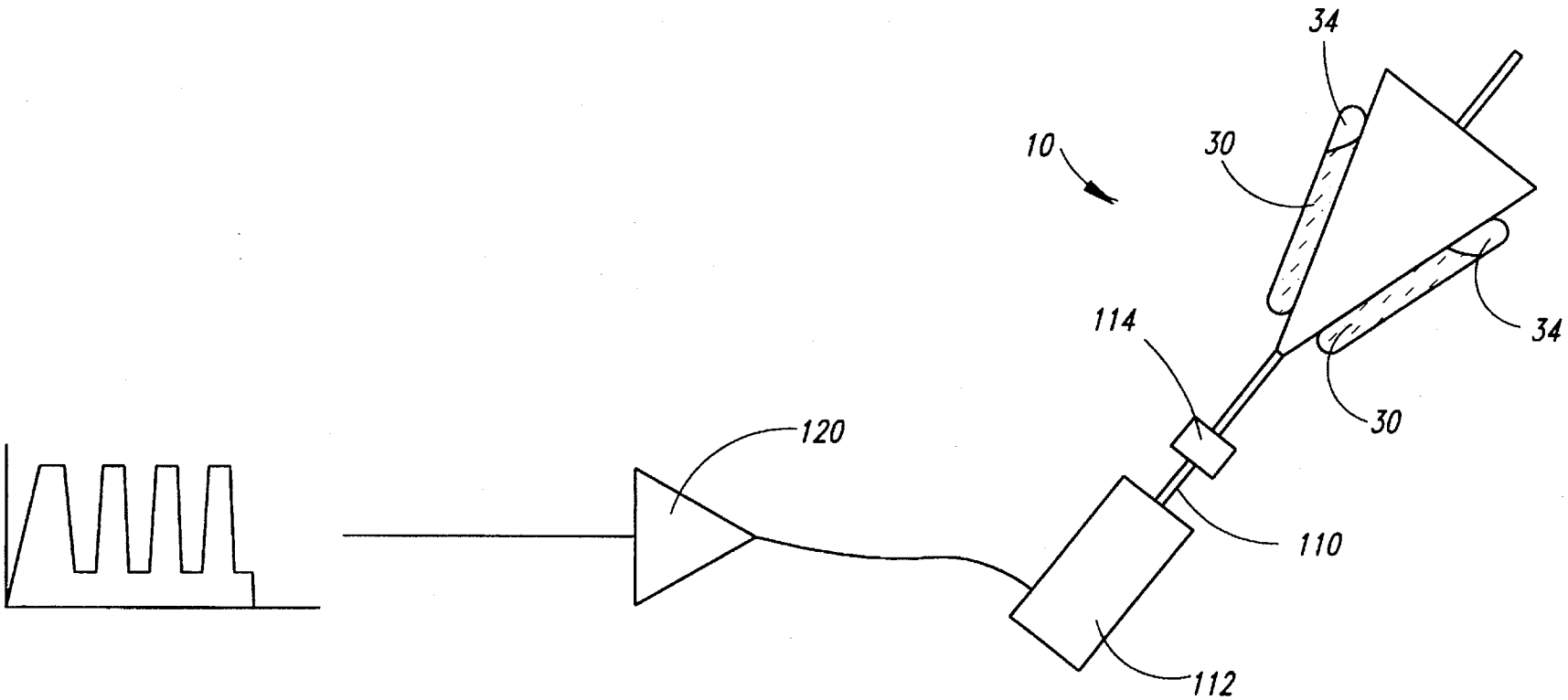
FIG. 11 is a schematic view of one embodiment of a device for rotating the mixing device of FIGS. 1 and 2.

A presently preferred embodiment of a drive system 100 for rotating the mixing device 10 of FIGS. 1 and 2 is illustrated in FIG. 11. The mixing device 10 is attached to a shaft 110 of a conventional DC motor 112 through a coupling 114. The shaft 110 is angled upwardly so that the ampules are angled upwardly when they are at their lowest point for the reasons explained above with reference to FIGS. 1–6.

The motor 112 is driven by a power amplifier 120 which is, in turn, driven by a signal shown in FIG. 11. The signal shown in FIG. 11 can be generated by conventional means. The signal alternates between two voltages, one of which drives the motor 112 at a relatively high speed to cause the bubble 34 to respond to centrifugal force and the other of which drives the motor 112 at a relatively low speed to cause the bubble 34 to respond to gravity. The signal remains at each of the two voltages for a period that is sufficient to allow the bubble 34 to move from one end of the ampule 30 to the other.

I claim:

1. A method of mixing a fluid having a plurality of components, comprising:

placing said fluid in an elongated ampule without completely filling said ampule so that said ampule contains said fluid and a gas bubble;

positioning said ampule symmetrically about an axis of rotation with the longitudinal axis of said ampule angled inwardly toward said axis of rotation so that a first end of said ampule is positioned farther from said axis of rotation than a second end of said ampule;

rotating said ampule about said axis of rotation; and causing a force exerted on said fluid in said ampule to alternate in opposite directions along the axis of said ampule thereby causing said bubble to alternately move in opposite directions to mix the components in said fluid in said ampule.

2. The method of claim 1 wherein said step of causing the force exerted on said fluids to alternate is accomplished by the steps of:

orienting said axis of rotation at an angle that is inclined upwardly in a manner so that the first end of said ampule is positioned beneath the second end of said ampule when said ampule is positioned directly beneath said axis of rotation; and varying the rotational velocity of said ampules about said axis of rotation between a stationary or relatively slow velocity in which a force is exerted on said fluid in the direction of said second end when an ampule containing said fluid is positioned beneath said axis thereby causing said bubble to move toward said first end, and a relatively high velocity in which a force is exerted on said fluid in the direction of said first end when an ampule containing said fluid is beneath said axis thereby causing said bubble to move toward said second end whereby said bubble alternately moves in opposite directions to mix components in said fluid in said ampule.

3. The method of claim 2 wherein said relatively slow velocity is sufficient fast to cause said bubble to flatten thereby providing a path to allow said fluid to flow past said bubble when said bubble moves from said second end toward said first end.

4. The method of claim 1 wherein said ampules are four in number, and said ampules are spaced at equal angles about said axis of rotation.

5. The method of claim 1 wherein said step of causing a force exerted on said fluids to alternate is accomplished by repetitively changing the orientation of said ampule so that the first end of said ampule is alternately positioned farther from said axis of rotation than said second end and closer to said axis of rotation than said second end as said ampule is rotated about said axis.

6. A device for storing and mixing a fluid having a plurality of components, comprising:

an elongated support having a longitudinal axis; and an elongated ampule containing said fluid and a gas bubble, said ampule being mounted on said elongated support spaced apart from said longitudinal axis with said ampule angled inwardly toward said longitudinal axis so that a first end of said ampule is positioned farther from said longitudinal axis than a second end of said ampule.

7. The device of claim 6 wherein said ampules are four in number, and said ampules are spaced symmetrically at equal angles about the longitudinal axis of said support.

8. The device of claim 6, further including a fluid chamber adapted to receive a body fluid for subsequent analysis.

9. The device of claim 8 wherein said fluid chamber is positioned on the longitudinal axis of said elongated support.

10. The device of claim 6 wherein said ampule is pivotally mounted on said elongated support, and wherein said device further includes an actuator alternately tipping the first end of said ampule toward and away from said elongated support.

11. The device of claim 10 wherein said actuator comprises:

a nut threaded onto a portion of a dome shaft;

a pair of stop members formed on said shaft at opposite ends of the threaded portion of said shaft; and an actuating arm pivotally connected to said ampule, said arms being pivotally secured to said nut.

12. A system for storing and mixing a fluid having a plurality of components, comprising:

an elongated support having a longitudinal axis;

an elongated ampule containing said fluid and a gas bubble, said ampule being mounted on said elongated support spaced apart from said longitudinal axis with said ampule angled inwardly toward said longitudinal axis so that a first end of said ampule is positioned farther from said longitudinal axis than a second end of said ampule; and a rotational device operatively coupled to said elongated support, said rotational device rotating said support about said longitudinal axis so that the centrifugal force exerted on the fluid in said ampule causes said bubble to move toward the second end of said ampule.

13. The system of claim 12 wherein while said support is coupled to said rotational device, said support is oriented at an angle that is inclined upwardly sufficiently so that said first end of said ampule is positioned beneath said second end when said ampule is positioned directly beneath the longitudinal axis of said support, and wherein said rotational device operates in at least two rotational velocities, a stationary or relatively slow velocity in which a force is exerted on said fluid in the direction of said second end when an ampule containing said fluid is positioned beneath said longitudinal axis thereby causing said bubble to move toward said first end, and a relatively high velocity in which a force is exerted on said fluid in the direction of said first end when an ampule containing said fluids is beneath said longitudinal axis thereby causing said bubble to move toward said second end whereby said bubble alternately moves in opposite directions to mix the components in said fluid in said ampule.

14. The system of claim 13 wherein said relatively slow velocity is sufficient fast to cause said bubble to flatten, thereby providing a path to allow said fluid to flow past said bubble when said bubble moves from said second end toward said first end.

15. The system of claim 12 wherein said ampules are four in number, and said ampules are spaced at equal angles about said axis of rotation.

16. The system of claim 12, further comprising:

a pivotal support securing said ampule to said elongated support so that said ampule can pivot between a first position in which the first end of said ampule is positioned farther from said longitudinal axis than the second end of said ampule, and a second position in which the second end of said ampule is positioned farther from said longitudinal axis than the first end of said ampule; and an actuating mechanism causing said ampule to alternately pivot between said first and second positions thereby causing a force exerted on said fluid in said ampule to alternate in opposite directions whereby said bubble alternately moves in opposite directions to mix the components in said fluid in said ampule.

17. The system of claim 16 wherein said actuating mechanism comprises:

a nut threaded onto a portion of a dome shaft;

a pair of stop members formed on said shaft at opposite ends of the threaded portion of said shaft; and an actuating arm pivotally connected to said ampule, said arm being pivotally secured to said nut.

18. The system of claim 12, further including a fluid chamber adapted to receive a body fluid for subsequent analysis.

19. The device of claim 18 wherein said fluid chamber is positioned on the longitudinal axis of said elongated support.

* * * * *